US007386913B2

(12) United States Patent
Jackson

(10) Patent No.: US 7,386,913 B2
(45) Date of Patent: Jun. 17, 2008

(54) CLEANING DEVICE WITH RELEASABLE, DISPOSABLE HEAD

(76) Inventor: Sally B. Jackson, 14 Shady La., Glen Gardner, NJ (US) 08826

( * ) Notice: Subject to any disclaimer, the term of this patent is extended or adjusted under 35 U.S.C. 154(b) by 239 days.

(21) Appl. No.: 11/071,681

(22) Filed: Mar. 3, 2005

(65) Prior Publication Data

US 2005/0204499 A1 Sep. 22, 2005

Related U.S. Application Data

(63) Continuation of application No. 10/197,081, filed on Jul. 17, 2002, now abandoned.

(51) Int. Cl.
*A47K 11/10* (2006.01)

(52) U.S. Cl. ..... 15/176.6; 15/145; 15/210.1; 15/176.1

(58) Field of Classification Search ..... 15/176.1, 15/176.6, 145, 210.1; 16/406; D4/130–138
See application file for complete search history.

(56) References Cited

U.S. PATENT DOCUMENTS

| | | | | |
|---|---|---|---|---|
| 2,247,526 A | | 7/1941 | Steinen | |
| 2,516,778 A | | 7/1950 | Kreidenweiss | |
| 4,247,216 A | * | 1/1981 | Pansini | 403/109.3 |
| 4,594,015 A | | 6/1986 | Pomares | |
| 4,754,516 A | * | 7/1988 | Tremblay | 15/176.6 |
| 5,020,182 A | | 6/1991 | Engel | |
| 5,435,328 A | | 7/1995 | Grohoske | |
| 5,471,697 A | | 12/1995 | Daconta | |
| 5,630,243 A | | 5/1997 | Federico et al. | |
| 5,737,792 A | * | 4/1998 | Quigless | 15/167.1 |
| 6,029,307 A | | 2/2000 | Baudoin | |
| 6,079,075 A | * | 6/2000 | Velez-Juan | 15/167.1 |
| 6,094,771 A | | 8/2000 | Egolf et al. | |
| 6,463,620 B2 | | 10/2002 | Busha | |
| 6,464,920 B1 | * | 10/2002 | Kramer | 264/243 |
| 6,745,427 B1 | * | 6/2004 | Trenz et al. | 15/104.94 |
| 2004/0129296 A1 | | 7/2004 | Treacy et al. | |

* cited by examiner

*Primary Examiner*—Shay L Karls
(74) *Attorney, Agent, or Firm*—Kenneth P. Glynn, Esq.

(57) ABSTRACT

A cleaning brush includes a handle member and a brush member that are connected in a locking/unlocking fashion and wherein they may be separated from one another by a locking mechanism component that is located on the handle member remotely from the brush member. The handle member has a first end handle portion and a second end having a mechanism for removably attaching the brush member. The brush member has one of a male and female fittage and the second end of the handle member has the other of the male fittage and the female fittage so the one slides into the other. These fittages are functionally positioned perpendicular to the elongated length of the handle.

10 Claims, 3 Drawing Sheets

FIG. 1
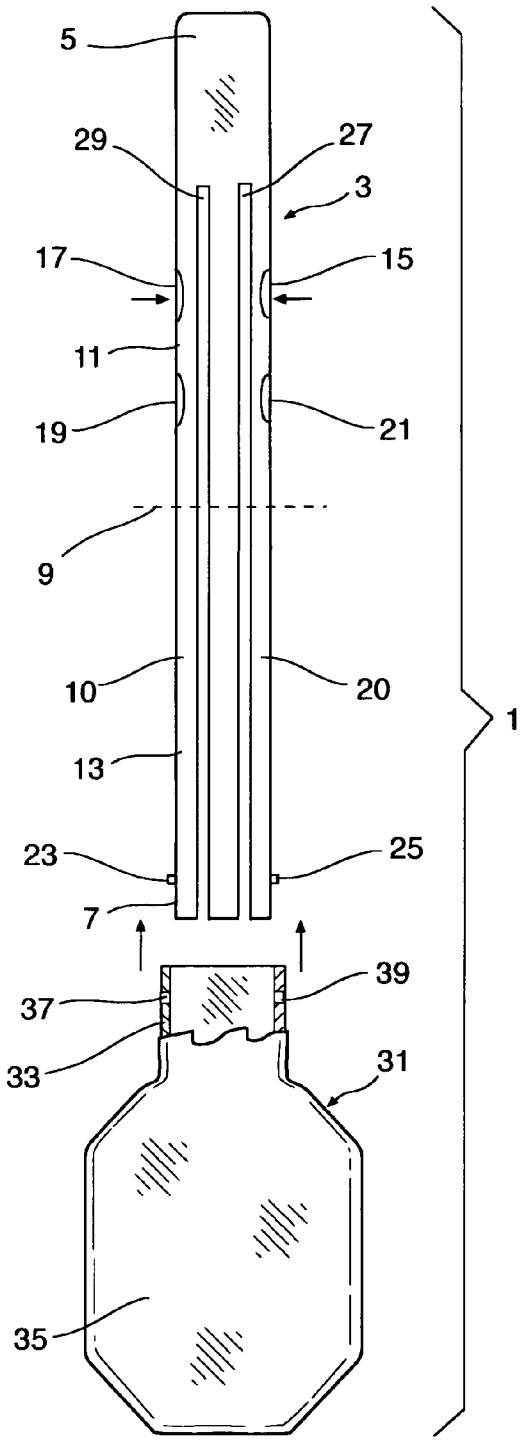
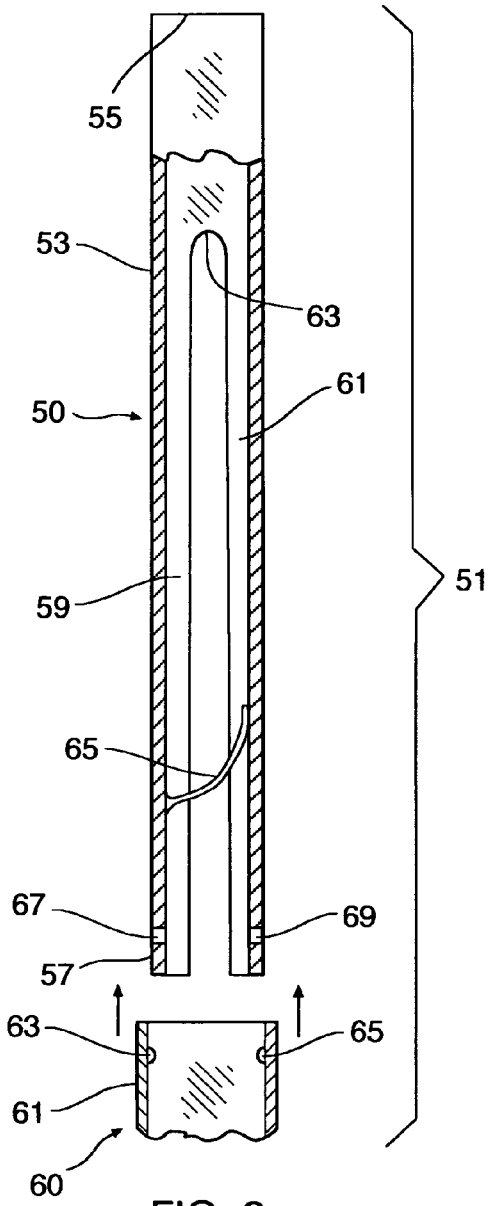
FIG. 2

CLEANING DEVICE WITH RELEASABLE, DISPOSABLE HEAD

REFERENCES TO RELATED CASES

This application is a continuation of U.S. application Ser. No. 10/197,081 filed on Jul. 17, 2002, now abandoned by the same inventor herein, and entitled "Cleaning Brush With Releasable, Disposable Head".

BACKGROUND OF THE INVENTION

1. Field of the Invention

The present invention relates to cleaning brushes, and, more specifically, to such brushes that are used for sanitary applications wherein a user may be reluctant to touch the brush end after use, e.g. after toilet cleaning. More specifically, the present invention cleaning brush has a releasable, disposable head with a release mechanism which is operated remotely from the brush head.

2. Information Disclosure Statement

The following patents illustrate various brush arrangements that show the state of the art:

U.S. Pat. No. 2,247,526 describes a mirror, brush or similar construction, a frame and handle assemblage to receive a mirror or brush element comprising a split resilient sheet metal channel rim and U-shaped cross section constituting the periphery of the frame, a separate handle member having a throat portion connected to said frame at the split in said channel rim, a backing member having an enlarged portion of the same shape and outline as the mirror and back of the brush element, the edges of said mirror or brush element and said backing member being tightly held within said channel rim and between the side flanges and drawn tightly up and resiliently wedged between said side flanges, said handle member being provided with an axial bore adjacent the frame and said backing member being provided with a threaded extension extending into said bore, said handle member being laterally pierced and said piercing being provided with parallel upper and lower faces and an elongated nut member fitted into said piercing also having upper and lower parallel end faces closely abutting the faces of said piercing and threaded upon said threaded extension and serving to draw up said handle upon said frame.

U.S. Pat. No. 2,516,778 describes a having a body portion having an integral circular plate head and an elongate flat solid handle portion, a central depression in the inner face of said head, a central opening in the outer face of said head communicating with said depression, a circular plate member threadably secured to said head within said depression, an annular shoulder on the outer marginal edge of said plate member, said shoulder adapted to engage the inner face of the head, to limit the movement of said plate member to form said central depression as a chamber within the head, said central opening in the outer face of said head being connected with said chamber, and sealing means about said central opening in the outer face of said head, truncated conical openings in said circular plate member, truncated conical plugs in said truncated conical openings, bristle tufts carried by said plugs, and central bores in said plugs within said tufts.

U.S. Pat. No. 4,594,015 describes a paint applicator having an essentially cylindrical paint container serving as a handle and formed of a resilient material, a threaded cap closing the container, a paint applicating head and a conduit connecting the applicating head to the paint container. The applicating head includes a metal plate affixed to the conduit and having an opening for the supply of paint, a layer of sponge-like material overlying the plate, a porous layer having a nap on one surface overlying the sponge-like material and a paint impervious layer covering at least the top edge of the sponge-like material.

U.S. Pat. No. 4,754,516 describes a brush that includes a movable handle in the form of nippers and head having a housing at least on one side, sized for receiving the handle. The latter is made up of two rods of equal length joined together at one of their ends and secured to the head by a set of notches and detents provided in the housing and the free ends of the handle. Securing of the handle to the head is obtained by latching of the detents in the notches. Such a brush is particularly advantageous inasmuch as it makes it extremely simple to replace the head by another one having identical or different size or shape.

U.S. Pat. No. 5,020,182 describes a device having a removable insert such as a brush, massage element or pad for applying lotions, medicines, and the like to human body. The device includes an elongated handle having a receptacle end provided with opposed inwardly facing grooves. The removable inserts are generally rectangular in shape and include integral spring biased tabs at the sides thereof. Each tab is provided with a locking stud that is received in a correspondingly shaped recess in the grooves. Each insert may include a brush, massage element, or disposable pad.

U.S. Pat. No. 5,435,328 describes a multi-purpose toiletry article which comprises: a long, rigid, plastic handle; a preferably oval rigid, plastic support head mounted in fixed or pivotal relationship at one end of such handle; and a removable fastener to removable and interchangeably affix one of a multiple of oval working members to said oval support head.

U.S. Pat. No. 5,471,697 relates to a cleaning device for cleaning various surfaces, such as the surfaces in and about a toilet, the device comprising a shaft defining a longitudinal axis and having a proximal end and a distal end, the proximal end adapted to be held by a user to manipulate the device; and a water soluble brush releasably fitted on the distal end of the shaft, wherein the brush is configured to dissolve in water. In a preferred embodiment of the device, the shaft is constructed of a water soluble material.

U.S. Pat. No. 5,630,243 describes a plastic tool with a handle and trigger at one end and a pair of jaws (one of which is moveable) at the other end which are inserted into a biodegradable paper cleaning pad filled with cleaning/disinfectant and/or deodorant materials. The lower jaw of the tool is moveable by way of a trigger near the handle. When depressed the trigger compresses a lock spring and moves an actuator rod down the barrel which operates a hinge to open the jaws far enough to be inserted into the cleaning pad. The open jaws surround a paper tab which forms the center of the double-walled cleaning envelope. On the release of the trigger the coil operating spring decompresses and moves the actuator rod back towards the handle locking the jaws over the center tab of the cleaning pad. Facilitated by a nominal 15-degree bend in the barrel of the cleaning tool and the flexible tip of the cleaning pad, the cleaning tool can reach all surfaces within the toilet to clean the unit. The soiled and used cleaning pad is disposed of by pointing the tools toward the toilet bowl and again squeezing the trigger, which causes the jaws to open and permits the used cleaning pad to drop into the toilet bowl to be flushed away.

U.S. Pat. No. 6,029,307 describes a kit for aiding in the drying and curling of hair that has a plurality of brushes which may be twisted into the hair and allowed to remain for a period of time to set a curl. Each of the brushes has a connector to which a handle can be removably attached such that a single handle can be used with all of the brushes in the kit.

U.S. Pat. No. 6,094,771 describes the WC cleaner that has a wipe which takes the form of a disposable wipe which is detachably retained on handle, off which it can be pushed. To this end the handle ahs an internal push-rod which is disposed displaceably in a continuous longitudinal bore in handle. After using the WC cleaner, the wipe can be pushed off by pushing the push-rod inside handle down so that it pushes the wipe out of the device holding it on the handle. The disposable wipe is flushed through the WC into the drainage system in the same way as WC paper. The storage device for the disposable wipes consists of a container which is open at the top and has a weighted base. The disposable wipes are stored stacked inside the container.

U.S. Pat. No. 6,463,620 B2 describes a brush assembly, such as for cleaning and sanitizing toilet bowls, having a removable and disposable applicator head. The brush assembly comprises an elongated handle with a broadening diverging end and an applicator head for removable attachment thereto. Dual locking means for the applicator head are provided, where the locking means may be manually released without having to physically handle a soiled applicator head.

U.S. Patent Application Publication No. U.S. 2004/0129296 A1 describes a cleaning apparatus including a substantially hollow tubular body having a bore extending therein, actuation means operably coupled to the body and including a plunger disposed within the body and a cleaning head detachably coupled to the body, wherein actuation of the plunger ejects the cleaning head from the body.

Notwithstanding the prior art, the present invention is neither taught nor rendered obvious thereby.

SUMMARY OF THE INVENTION

The present invention cleaning brush includes a handle member and a brush member which are connected to one another in a locking/unlocking fashion and wherein they are separated from one another by a mechanism component that is located on the handle member remotely from the brush member. The brush member is made of biodegradable material. The handle member has a first end and a second end, with the first end having a handle portion and the second end having means for removably attaching the brush member. The brush member is removably attached to the second end of the handle member. The brush member has one of a male and female fittage and the second end of the handle member has the other of the male fittage and said female fittage so the one slides into the other. The male fittage and the female fittage are functionally positioned perpendicularly to the elongated length of the handle member. There is a locking mechanism for locking and unlocking the male fittage and the female fittage relative to one another. The locking mechanism includes lock-unlock manually operated component remotely located from the brush member, typically toward or near the first end of the handle member. The handle member may include a gripping area adjacent to its first end.

In some present invention cleaning brush embodiments, the handle member is at least partially hollow and the locking mechanism is contained within the hollow area.

In one preferred embodiment, the cleaning brush handle member is at least partially hollow and includes at least two slits beginning at the second end and extending towards the first end so as to create at least two flexible sections. These at least two flexible sections each contain one of a protrusion or a recess, and the brush member contains the other of the protrusion and the recess such that, in a rest position, the brush member is connected to the handle member at the male and the female fittages with the protrusions interlocking with the recesses, and, in a non-rest position, wherein when a user squeezes the at least two flexible sections, the protrusions are removed from the recesses so as to unlock said brush member from the handle member.

In other present invention embodiments, the cleaning brush handle member is at least partially hollow and the locking mechanism includes a lock-unlock latch adjacent the second end of the handle member and a lock-unlock manually operated component connected thereto. The manually operated component is remotely located from the second end, and the lock-unlock manually operated component is selected from the group consisting of a button, a switch, a knob, a trigger, a dial, and a pull.

In some embodiments, the brush member may be made of biodegradable material. It may be a flat or rounded structure, with a pod, a sponge, bristles, or any other scrubbing or cleaning adaptation.

In many preferred embodiments of the present invention cleaning brush, the handle member has the male fittage and the brush member has female fittage, so that the handle member slides into the brush member. Further, although a circular cross-section for the fittages is typical for the present invention cleaning brush, the cross-sections could be of any choice, e.g. square, rectangular, oval, hexagonal, irregular, etc, as long as they fit into on another.

In some embodiments, the cleaning brush handle member contains the recesses and the brush member contains the protrusions which extend outwardly therefrom and are adapted to fit into the recesses. In other embodiments, the opposite arrangement may be employed. The recesses may be orifices or indentations, and orifices are preferred.

In the present invention preferred embodiments, the handle member has a first end and a second end, and the handle member has two halves, a first half extending from a midpoint to the first end and a second half extending from that midpoint to the second end. The first end has a handle portion, i.e. an area that is adapted to be hand held, and the second end has means for removably attaching the brush member. This foregoing establishes more specifically that, in preferred embodiments, the operating component of the lock-unlock mechanism is not only remotely located, but is located in the upper half of the handle member.

BRIEF DESCRIPTION OF THE DRAWINGS

The present invention should be more fully understood when the specification herein is taken in conjunction with the drawings appended hereto wherein:

FIG. 1 shows a front view of one preferred embodiment of a present invention cleaning brush;

FIG. 2 shows an alternative embodiment present invention cleansing brush utilizing recesses in the handle member wherein the handle member contains the male fittage;

DETAILED DESCRIPTION OF THE PRESENT INVENTION

Figure 3:
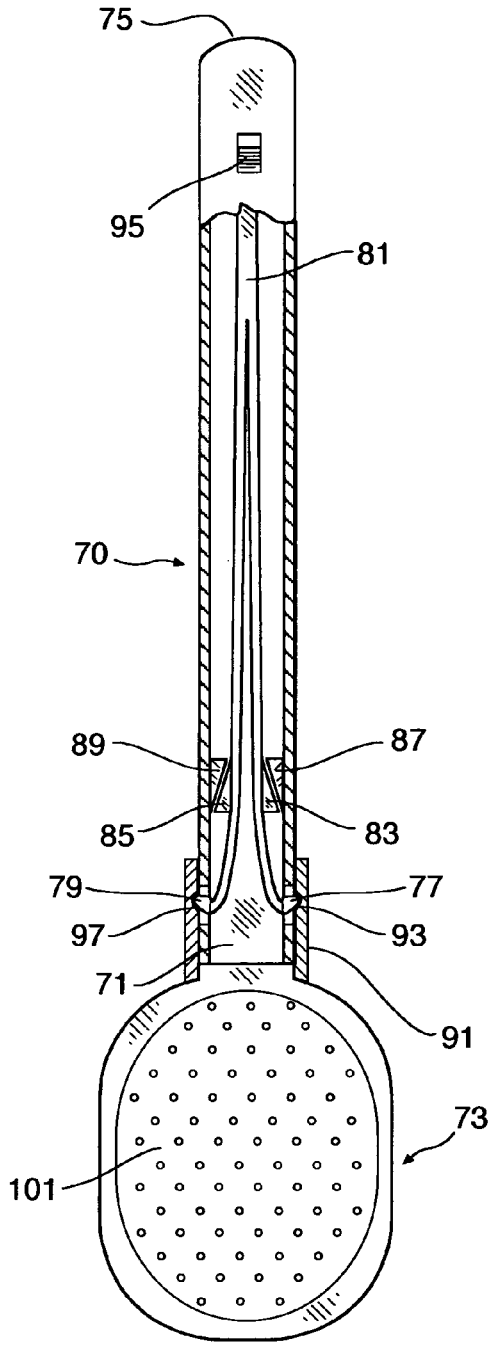
FIG. 3 shows a front view of another alternative present invention cleaning brush utilizing a slide button manually operated component of the locking mechanism which is remotely located from the brush member.

FIG. 1 shows one preferred embodiment of a present invention cleaning brush 1. In this top view there is a handle member 3 adapted for connection to a brush member 31. Handle member 3 has a first end 5 and a second end 7. There is a midpoint 9 and above it to first end 5 which forms a handle portion formed of first section 11 which is inherently adapted to the handheld by its elongated shape and size. It could be cross sectionally round, square, hexagonal, rectangular, or otherwise, or could even have an irregular shape. Below midpoint 9 down to second end 7 is second half 13 adapted for and including means for removably attaching brush member 31. Second half 13 has protrusions 23 and 25 as shown and, because of cutout areas 27 and 29, segments 10 and 20 will, in a spring like fashion, close together when squeezed so as to permit the male fittage formed at second end 7 to be inserted into female fittage 33 of brush member 31. This is done by squeezing handle member 3 at areas 15 and 17 or 19 and 21. Upon insertion and release, protrusions 23 and 25 will pop into recesses 37 and 39 of female fittage 33 to secure brush 31 in a locked fashion to handle member 3.

Pad 35 of the brush member 31 is utilized to clean, for example, sanitary facilities such as toilet bowls and bidets. Thereafter, the brush member 31 may be disposed of simply by squeezing the handle member 3 to cause inserts 23 and 25 to pull inwardly away from recesses 37 and 39 so that brush member 31 drops away. Thus, a user need not touch the wet or contaminated portions of the handle member 3 or the brush member 31.

FIG. 2 shows a partial top view of an alternative embodiment present invention cleaning brush 51. It is similar to that shown in FIG. 1 . However, this version has reversed the protrusions and recesses, and, additionally, relies upon an internal living spring in the handle member.

Handle member 50 is segmented by cutouts such as cutout 63 to form segments 59 and 61, for example. First end 55 and second end 57, function similarly to that which is described in FIG. 1. Handle portion 53 is squeezed against the spring force of molded plastic living spring 65 so that second end 57 may be inserted into female fittage 61 of brush member 60. Upon release, recesses 67 and 69 fit into protrusions 63 and 65 so as to secure the brush member 60 until used. Thereafter, a simple squeeze of handle member 50 will release brush member 60 for instant, hands-free disposal.

In any of the above or below embodiments, the male and female fittages may be reversed so that the brush member fits into the handle member. In some embodiments, the brush member may be biodegradable, as, in the case of biodegradable plastics and or cellulosic or other degradable materials.

FIGS. 3, 4, 5, and 6 show views of various brushes which have a variety of possible remotely located lock operating mechanisms and different types of brushes. With respect to all of these figures, identical parts are identically numbered and are discussed only once in detail.

FIG. 3 shows a present invention cleaning brush having a handle member 70 and a brush member 73. There is a first end 75 and a second end 71 of handle member 70, with first end 75 terminating a handle, and including slide button 95. Second end 71 includes protrusions 77 and 79, which fit into recesses 93 and 97 of female fittage 91 of brush member 73 when the handle member 70 and the brush member 73 are connected.

When slide button 95 is moved upwardly, rod 81 and fins 83 and 85 also move upwardly such that fins and 85 ride up stationary ramps 87 and 89 so as to be squeezed together and so as to pull protrusions 77 and 79 away from recesses 93 and 97, rendering brush member 73 free to drop away from handle member 70.

Brush member 73 has a bristled brush base 101, as shown. Alternatively, the brush member could be a spherical, elliptical, ovate, or other shaped structure formed of bristles, strands, cloth, sponge, or any other cleaning structure.

Figure 4:
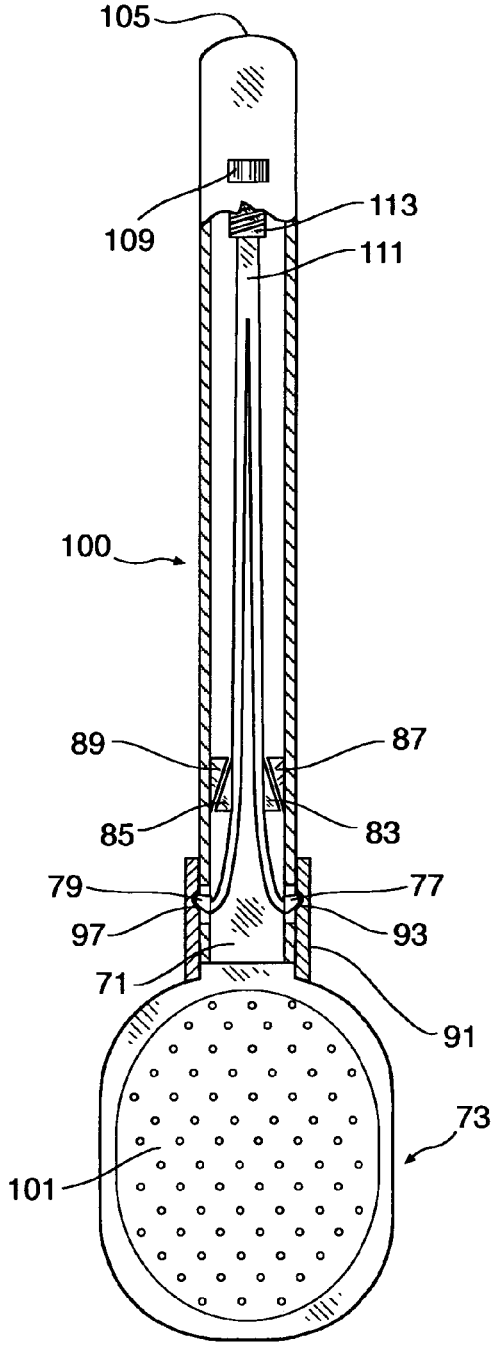
FIG. 4 shows yet another present invention cleaning brush wherein a rotating dial is used to operate the blocking mechanism from the brush member.

In FIG. 4, brush member 73 is identical to that shown in FIG. 3 and handle member 100 is similar to handle member 70 of FIG. 3, except that a wheel or dial replaces the button and appropriate internal modification has been made. Specifically, first end 105 of handle member 100 has a rotating dial 109 which is internally threaded and causes the threaded section 113 and rod 111 to rise or lower in response to rotating. This permits hand-free removal of brush member 73, as desired.

Figure 5:
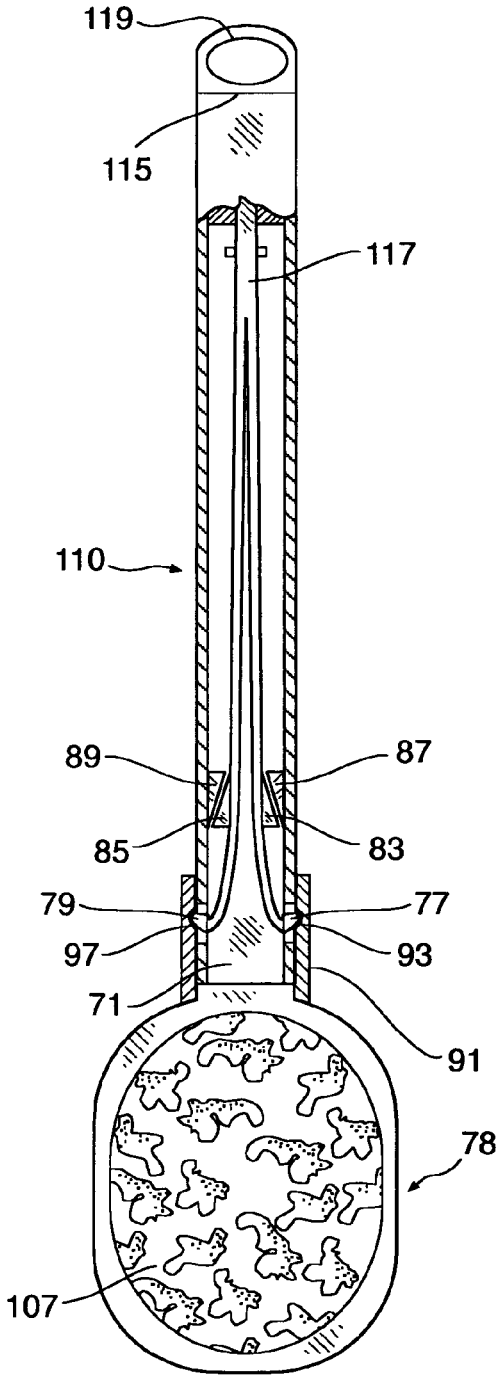
FIG. 5 shows yet another present invention cleaning brush wherein a pull is used to operate the blocking mechanism from the brush member.
Figure 6:
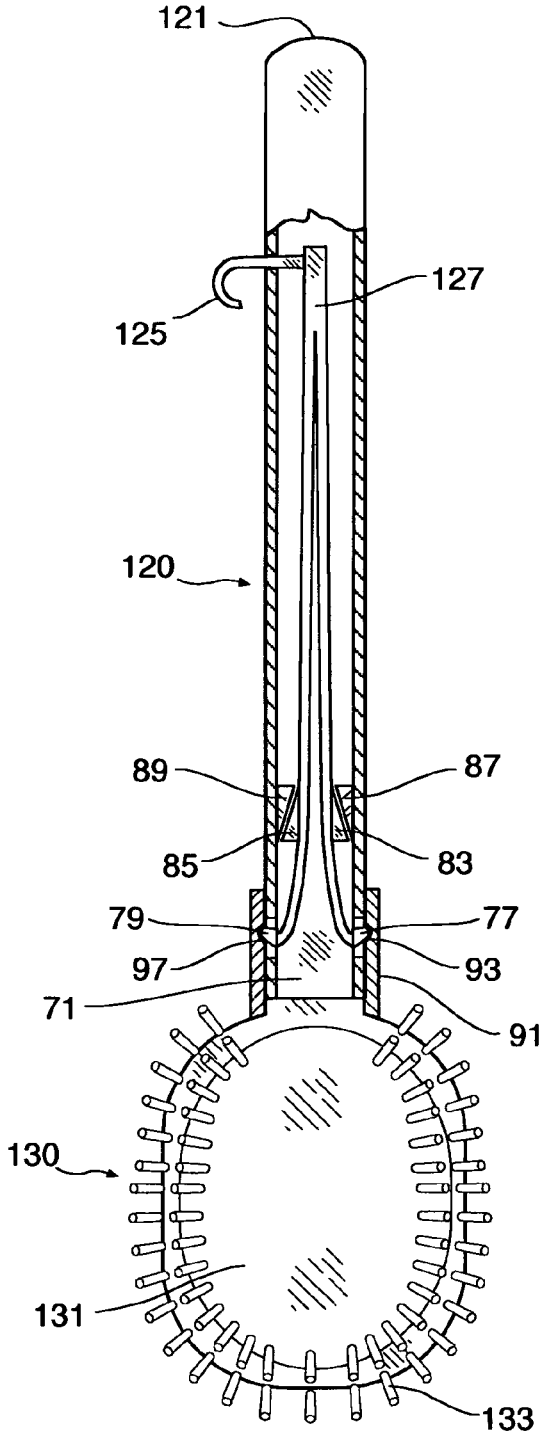
FIG. 6 shows another present invention cleaning brush wherein a trigger is used to operate the blocking mechanism from the brush member.

FIG. 5 shows a device similar to FIGS. 3 and 4, except that brush member 78 includes a sponge 107 and handle member 110 has a pull 119 at first end 115 of handle member 110 to move rod 117 upwardly to withdraw protrusions 77 and 79 from recesses 93 and 97. Likewise, FIG. 6 is also similar except that first end 121 has a trigger 125 for upward movement of rod 127 to effect activation of the unlocking feature. Additionally, brush member 130 has a hollow center 131 and a donut-shaped configuration with bristles, such as bristle 131.

Obviously, numerous modifications and variations of the present invention are possible in light of the above teachings. It is therefore understood that within the scope of the appended claims, the invention may be practiced otherwise than as specifically described herein.

What is claimed is:

1. A cleaning brush, which comprises:

a.) an elongated, at least partially hollow handle member having an elongated length, and having a first end and a second end, said first end having a handle portion and second end having means for removably attaching a brush member;

b.) a brush member removably attached to said second end of said handle member, wherein said brush member is of biodegradable material;

c.) a male fittage located on one of said brush member and said second end of said handle member, and a corresponding female fittage located on the other of said brush member and said second end of said handle member, wherein said male fittage and said female fittage are functionally positioned perpendicularly to said elongated length of said handle member; and, d.) a locking mechanism for locking and unlocking said male fittage and said female fittage relative to one another, said locking mechanism including at least two slits located on said handle member beginning at said second end of said handle member and extending more than half way up the handle towards said first end of said handle member so as to create at least two flexible sections, and including a lock-unlock manually operated component remotely located from said brush member and from said male fittage and said female fittage, on one of said at least two flexible sections;

wherein said male fittage is locked within said female fittage in a rest position, and, wherein, when a user squeezes said at least two flexible sections to a non-rest position, said male fittage removed from said female fittage so as to unlock said brush member from said handle member.

2. The cleaning brush of claim 1 wherein said handle member includes a gripping area adjacent to its first end.

3. The cleaning brush of claim 1 wherein said brush member has a plurality of bristles.

4. The cleaning brush of claim 1 wherein said handle member has a male fittage and said brush member has a female fittage.

5. The cleaning brush of claim 4 wherein said brush member has a plurality of bristles.

6. The cleaning brush of claim 1 wherein said lock-unlock manually operated component is at least one delineated squeeze area on said handle.

7. The cleaning brush of claim 6 wherein said female fittage are orifices.

8. The cleaning brush of claim 6 wherein said handle member includes a gripping area adjacent to its first end.

9. The cleaning brush of claim 6 wherein said brush member has a plurality of bristles.

10. The cleaning brush of claim 6 wherein said handle member has a male fittage and said brush member has a female fittage.

* * * * *